US005447470A

United States Patent [19]

Zaniewski

[11] Patent Number: 5,447,470

[45] Date of Patent: Sep. 5, 1995

[54] APPARATUS INSURING DISTRIBUTION AND AUTOMATIC CONTROL OF AIR SUPPLIES, IN PARTICULAR FOR VENTILATION OF BUILDINGS

[76] Inventor: Michel H. Zaniewski, B.P. 155, Avenue Ferdinand de Lesseps, 34110 Frontignan, France

[21] Appl. No.: 66,978

[22] Filed: May 25, 1993

[30] Foreign Application Priority Data

May 27, 1992 [FR] France ..... 92 06596

[51] Int. Cl.[6] ..... F24F 13/18

[52] U.S. Cl. ..... 454/259; 454/227; 454/250; 454/271

[58] Field of Search ..... 454/196, 227, 250, 255, 454/259, 271

[56] References Cited

U.S. PATENT DOCUMENTS

| | | | |
|---|---|---|---|
| 426,628 | 4/1890 | Smith | 454/255 X |
| 1,874,083 | 8/1932 | Clay | 454/250 |
| 5,080,005 | 1/1992 | Kolt | 454/259 X |

FOREIGN PATENT DOCUMENTS

| | | |
|---|---|---|
| 0362913 | 4/1990 | European Pat. Off. . |
| 2549208 | 1/1985 | France . |
| 325380 | 10/1957 | Switzerland . |
| 2062842 | 5/1981 | United Kingdom . |

*Primary Examiner*—Harold Joyce
*Attorney, Agent, or Firm*—Horst M. Kasper

[57] ABSTRACT

An apparatus for the automatic control of ventilation of premises comprising a flexible flat membrane (11) attached by one of its edges in the interior of the casing (12) on the upper wall between two opposed openings (18) and (19). The upper wall supports the membrane. The membrane buckles and bends under the effect of an air current flowing through said casing in order to seal and block one of the openings (18) or (19) to a larger or smaller extent. The bending strength of the flexible planar membrane (11) is made different according to the direction of actuation of the membrane by the presence of the stops (13) and (15) which have a different length on both sides its attachment. This difference can be increased by the presence of perforations and holes in the membrane at the level of the stop closest to the attachments.

20 Claims, 7 Drawing Sheets

APPARATUS INSURING DISTRIBUTION AND AUTOMATIC CONTROL OF AIR SUPPLIES, IN PARTICULAR FOR VENTILATION OF BUILDINGS

BACKGROUND OF THE INVENTION

1. Field of the Invention

The invention relates to a ventilation-control device for premises.

2. Brief Description of the Background of the Invention Including Prior Art

The fronts of the outside of modern buildings or of renovated old buildings are thermally insulated and the door frames and the window frames are furnished with jointing with the goal of saving energy.

The relative imperviousness thus obtained causes in confined accommodations an excessive of condensation, of mold and mildew, which condensation, old and mildew deteriorate the structure and the furniture, and which can be injurious, hurtful and ill-fated to the health of the occupants, in particular during periods of time when the windows remain closed.

Therefore, it has been proposed to furnish an aeration apparatus which assures, according to the adjustment, a general and continuous renewal of the air but which apparatus is controlled in a way such as to assure in each room the necessary ventilation output depending on the purpose and destination, such as the living room, the bathroom, the kitchen, the toilet, etc. and depending on the time of utilization such as during meal times, among others. For this purpose, an apparatus is known which is intended to automatically control the output of air which runs through each ventilation opening of the rooms. Said apparatus is formed by a box which is located at the level of each said openings and which box includes two openings on two sides of the box. Said openings can be alternatively and more or less blocked, depending on the direction and the speed of the air current flowing through the openings, by a soft membrane which is placed in a stable position of equilibrium being suspended and hung freely between the two openings of said box. However, it has been noticed that the softness of said membrane does not allow a perfect control and adjustment, because the smallest current of air running through this apparatus causes a nearly total blocking of the corresponding opening.

SUMMARY OF THE INVENTION

1. Purposes of the Invention

It is an object of the present invention to provide improvements for such a ventilation-control device with the purpose of obtaining a control as modulated as possible.

It is another object of the invention to provide a manual and easy control of the ventilation required for different rooms.

It is yet a further purpose of the invention to provide a flow control which at the same time allows to block any reverse flow which might occur.

These and other objects and advantages of the present invention will become evident from the description which follows.

2. Brief Description of the Invention

According to the present invention the membrane, which is placed between two openings of the box furnished at each opening of the room is not any longer a soft membrane but is a flexible flat membrane which is structured in such manner that it presents a resistance to the different bending according to the direction of the air current which induces such bending. Moreover, an adjustable stop device allows to limit in a variable way the bending angle of the membrane in order to control the surface of the opening blocked by thus bent membrane.

An automatic control device for ventilation comprises a casing having two opposite faces and furnished with two openings and an upper wall. The openings are disposed on the opposite faces of the casing. A flexible membrane exhibits a horizontal edge, is capable of furnishing a plane surface, and is contained in the casing between the two openings. The membrane is disposed and fastened edgewise at the horizontal edge of the membrane. The membrane is free to oscillate under the action of an air current which flows through said casing in order to block more or less one of the two openings according to the direction of the air current. The membrane is attached in such a way that the bending moment experienced by the membrane subjected to an air current is different depending on a direction of actuation of said membrane by the air current.

The flexible membrane can be planar and can be mounted at the level of one of its horizontal edges between a first stop and a second stop. One of the first stop and of the second stop can be longer as compared to the other stop in a manner for modifying the effective length of said membrane facing the air current depending on the direction in which the membrane is actuated by the air current, and thereby modifying the bending moment to which said membrane is subjected.

Elongated slot holes can be disposed in the membrane and furnished in said membrane at the level of an attachment point of the membrane on the shorter one of the first stop and second stop. A bending strength difference of the membrane in one of said directions can be increased by the presence of the slot holes, thereby reasonably reducing in this point a surface of remaining material in such a way that a bending of the membrane takes place at the level of the line of the elongated slot holes in a direction, where the membrane is abutted against this shorter stop and moves beyond the zone of the elongated slot holes in the direction where said membrane abuts against a longer one of the first stop and of the second stop.

The membrane can be retained by tenons on the first stop. The membrane can be immobilized relative to the first stop by having the second stop detachable and in a form of a gripper. The second stop can enclose said first stop. A plate can have an edge and include dovetails disposed at the edge of the plate. Said first stop can be integral with the plate. The plate can be introduced into the upper wall of the casing by translatory motion, guided by the dovetails.

The flexible membrane can be positioned edgewise in a floor base of the casing.

A small bar can be placed horizontally across a rear one of the two openings. A level of positioning the said small bar can be controlled with a purpose of controlling a surface allowing passage of air through said opening. A displacement of the membrane in a direction of its largest bending strength can be limited by the small bar. The level of the membrane at a position of the small bar can be adjusted such that the membrane can pass through the rear opening, thereby freeing the rear opening completely and allowing passage of air through the rear opening.

The casing can be provided in the shape of an elongated prism. Said casing is capable of being introduced into the interior of extruded elements of metallic joinery.

A slide can be located at the floor base of a vertical plate of the casing. The membrane can be positioned edgewise on said slide. A bending strength of said membrane can be increased by the first stop in the bending of the membrane for attaining a rear one of the two openings based on a strength of the air current penetrating through the rear opening. The rear opening can be defined by said plate.

A rigid, pierced and perforated filter can exhibit a half-cylindrical shape and dovetails located on each one of outer generating lines of said filter. The rigid, pierced and perforated filter can comprise a fine grid in its interior. The casing can include in its upper part a third opening covered with the rigid, pierced and perforated filter. The rigid, pierced and perforated filter can be retained in said casing at the level of said third opening by means of the dovetails.

A radial slot can be carried by the rigid, pierced and perforated filter on each of lateral extremities of the rigid, pierced and perforated filter. The rigid, pierced and perforated filter can be furnished at two sides of an outer periphery of the rigid, pierced and perforated filter with ergots. The dovetails can be male and the ergots can be disposed in the neighborhood of the male dovetails. The ergots can cooperate with the male dovetails in order to allow support of the rigid, pierced and perforated filter by a locking pawl at the level of a respective wall opening such that the third opening of the casing can be located at the outside of a window frame and of an opening of a metallic joinery into which the casing is introduced.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
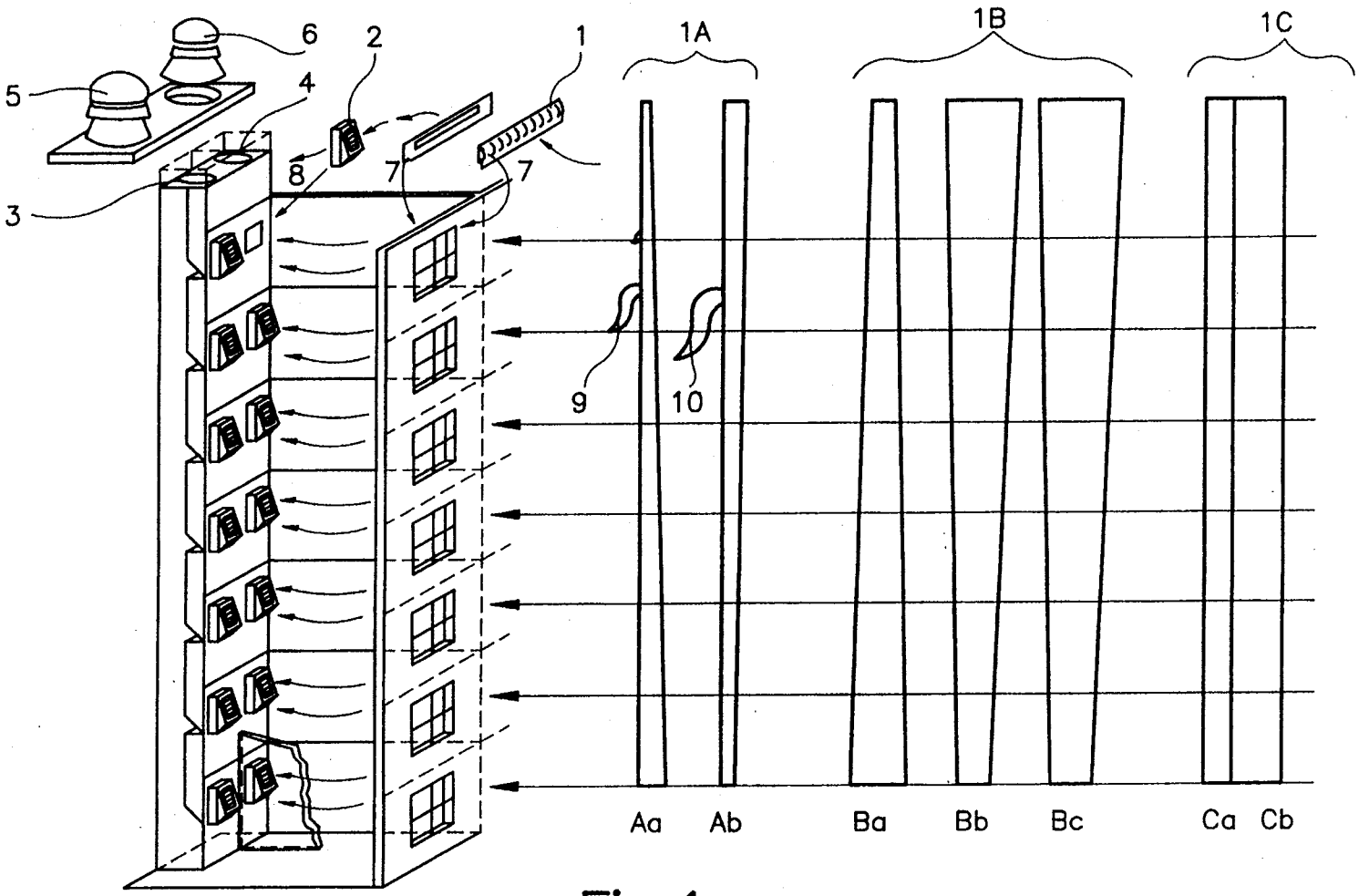
FIG. 1 is an explanatory diagram of the effect of an automatic control of the ventilation of rooms generated by the invention apparatus.

According to the present invention, there is provided for an automatic control device for ventilation, in particular for premises. The automatic control device for ventilation includes a membrane contained in a casing which is furnished with two openings which are disposed on opposite faces of the casing. The membrane is disposed between the two openings and is fastened by one of its horizontal edges. The membrane is allowed to oscillate freely under the action of an air current which flows through said casing in order to block more or less one of the openings according to the direction of the air current. The flexible membrane 11 furnishes a plane surface and is retained in the casing 12, furnished with the oppositely disposed openings 18 and 19 in such a way that the bending moment is different according to the direction in which said membrane 11 is actuated by the air current.

The flexible membrane 11 can be planar and can be fitted and inserted on a level of one of its horizontal edges between two stops 13 and 15. One of the two stops, for example the stop 13, can be longer than the second stop 15 such as to modify an insertion length of said membrane 11 depending on the direction in which it is actuated, thereby modifying in each bending direction the bending moment to which said membrane 11 is subjected.

A bending strength difference of the membrane 11 can be increased by a presence of a line of elongated slot holes 17 which are furnished in said membrane at a level where the membrane 11 rests on the shorter, second stop 15, thereby substantially reducing in this point the surface of remaining material of the membrane 11 in such a way that its bending takes place at the level of the line of elongated slot holes 17 such that the membrane rests on said second stop 15. A bending of the membrane 11 beyond a zone of the elongated slot holes 17 can take place such that said membrane 11 comes to rest on the longer stop 13 which is the most distant from the insertion.

The membrane 11 can be retained by tenons and joggles 14 on the stop 13. The membrane 11 can be immobilized relative to the stop 13 by the detachable stop 15 in the form of a clamp which grips said stop 13.

Said stop 13 can be integral with a plate 16 introduced into an upper wall of the casing 12 by translatory motion, guided by dovetails bordering said plate 16.

The flexible membrane 11 can be positioned edgewise on a floor base of the casing 12.

A displacement of the membrane 11 in a direction of its largest bending strength can be limited by a small bar 20 placed horizontally across a rear opening 19 with the purpose of controlling a surface of air passage through said opening. A height level of the small bar 20 can be such that the membrane 11 can pass across the rear opening 19, thereby clearing the rear opening 19 completely. The height level of said small bar 20 is controllable.

The casing 12 can be shaped like an elongated prism 23 which is capable of being introduced inside extruded elements of a metallic joinery 34.

The membrane 11 clan be positioned edgewise on a slide 25 located on the floor base of a vertical plate 24 of the casing 23. A bending strength of said membrane 11 can be increased by the stop 13 in its bending for reaching a rear opening 26 of said vertical plate 24 based on the air current penetrating through the opening 18 of said casing.

The casing 23 can include in its upper part an opening 27. The opening 27 can be capped with a rigid, pierced and perforated, hemicylindrical filter 28. Said filter 28 can be lined inside with a fine grid. Said filter 28 can be retained in said casing 23 at a level of said opening 27 by means of dovetails 30 located on each one of the generating line extremities of said filter 28.

The filter 28 can include on each one of its lateral extremities a radial slot 31 and can be furnished at its outer periphery, on both sides of said lateral extremities, with ergots 32. The ergots 32 can be disposed in the neighborhood of the male dovetails 30. The ergots 32 can cooperate with the male dovetails 30 in order to allow a support of the filter by a locking at a level of each of the openings, such as the opening 27 of the casing 23 at the outside of a window frame 35 and an opening 33 of the metallic joinery 34 into which the casing 12 is introduced.

FIG. 1 illustrates by way of example a building of several stories furnished with ventilation systems. The renewal of the air is assured by an air current controlled by different mechanical or static apparatus which are mainly formed by:

apparatus perfected for the clean air entrance 1
apparatus perfected for the used air discharge 2
vent pipes of the air coming from kitchens 3 and toilets and bathrooms 4
air exhausters of the mechanical static type 5 and 6.

The apparatus perfected for the clean air entrance 1 are separately disposed on the openings which are furnished on the exterior walls of so-called dry rooms such as bedrooms, living rooms, drawing rooms, in particular on the upper joinery 7.

The apparatus for the used air discharge 2 are placed at the ventilation-openings of the so-called damp rooms, in particular on the openings 8 which are connected to the collective ventilation conduit 3 of kitchens and to the collective ventilation conduit 4 of toilets and bathrooms. The ventilation conduit 4 can be provided by an air shaft, a ventilating shaft, or a pipe.

The air exhausters, which are placed at the top of the ventilation conduit lines 3 and 4 are of the mechanical static type which can operate both in a mechanical way or in a static way and, according to the standards, exhaust in these ventilation conduits 4 in order to furnish, according to their slow or rapid mode of operation, a reduced or intense global air output distributed to each room by way of each individual control device placed at the level of each air-entrance or air-discharge ventilation opening.

The present invention relates to the improvement of the air entrance apparatus 1 and of the air discharge apparatus 2 with a view of better distributing in each apartment the global output furnished by the air-exhausters 5 or 6.

These improvements allow to provide a first adjustment of the output of each apparatus in the factory with a possibility of additional adjustments when they are put in place on the construction site, considering the localized requirements which can vary depending on the possible porosity of the ventilation conduits based on their faults relating to imperviousness and tightness or depending on the regulatory restrictions, for example.

In parallel to this role of automatic control, these apparatus assure a better safety and better protect the health of the inhabitants by spontaneously opposing perturbations caused by the wind, which is due in particular to the improved reverse-lock and anti-blowing properties of these apparatus.

The graphic representations $1_A$, $1_B$, $1_C$ of FIG. 1 reconstruct schematically the chronological development of the outputs as a function of the kind of the ventilation apparatus installed. They justify the complementarity of the assembly of the components according to three configurations.

The graphic representation $1_A$ shows the intensity of the ventilation at the level of different stories not yet equipped with control devices.

The graphic representation $1_B$ shows the intensity of the ventilation at the level of the different stories after installation of the air exhausters 5 or 6 at the top of the collective ventilation conduits 3 and 4.

The graphic representation $1_C$ shows the intensity of the ventilation at the level of the different stories after a complete installation of different ventilation production members 5 or 6 and of previously recited different apparatus 1, 2, 3, 4 for a specific control of each room.

According to the graphic representation $A_a$, which shows the case where the exhaust in the ventilation conduits 3 and 4 is due only to a thermal effect, one observes a clearly insufficient output which is reduced from the bottom to the top up to risking of being actually zero at the upper levels.

According to the graphic representation $A_b$, which shows the case $A_a$ during windy times benefiting from a weak venturi effect at the discharge level of the ventilation conduits 3 and 4, the result is reversed. One observes at the level of the upper lodgings a still insufficient output, even though slightly better, which output reduces from the top to the bottom until risking to be nearly zero at the lower level.

One observes frequently the rebounding of used air at the level of the lodgings of the upper floors such as it is schematically shown at the level 9 in the case of the representation $A_a$ and at the level 10 in the case of the representation $A_b$ in this kind of ventilation conduit which is not at all or poorly equipped with discharge and exit devices.

These perturbations are generally caused by the loss of excessive loading which result, amongst other causes, from exhausters which are not performing or which are not conforming to the discharge standards of the conduit lines.

According to the graphic representation $B_a$, which shows the case where the exhausting in the ventilation conduits 3 and 4 is assisted by a powered venturi exhauster, with a stopped motor, one observes at the level of the lower-floor lodgings, in particular, during the time of the cold season, a clearly improved thermal output which, going from bottom to the top, while it reduces at the upper levels, it is nevertheless sufficient.

According to the graphic $B_b$, which shows the case where the exhaust in the ventilation conduits 3 and 4 is being assisted by the same static exhauster swept and scavenged by the wind, one notes at the discharge of the ventilation conduit with the motor stopped, that the result is reversed and one observes at the level of the upper floor apartments an absolutely improved output, which output, going from the top to the bottom, while the output reduces and thins down at the lower levels, the output nevertheless remains substantially sufficient.

According to the graphic representation $B_c$, which shows the case where the mechanic static exhausters 5 and 6, placed at the top of the ventilation conduits 3 and 4, are agitated by their engine, one observes the same proportional result from the top to the bottom, only during windy times shown in the representation $B_b$, however, with plainly excessive outputs, in particular, in the lodgings of the upper floors. One notes sufficient or excessive outputs according to the graphic representations $B_a$, $B_b$, $B_c$ with respect to the partially equipped ventilation conduits, and the outputs consequently require to be divided and distributed and metered.

In each of the graphic representations $C_a$ and $C_b$, which show both, an installation which is completely equipped with the exhausters 5 and 6 at the top of the ventilation conduits 3 and 4, as well as control apparatus 1, 2, 3, and 4 at the level of each apartment, one notes that the output is the same for all of the floors, be it in the mode of reduced operation $C_a$ or in the mode of intensive operation $C_b$.

This distribution and this metering is the result of the improvement of the complementary air entrance and air discharge apparatus, which complementary air entrance and air discharge apparatus are the subject matter of the present invention.

A static exhauster is an exhauster which is formed such that without agitation it will result in a ventilation. A mechanical exhauster is an apparatus, which moves and exhausts the air by mechanical construction or action, for example, by ventilation wheel.

The attached drawings are only examples which are not limiting of such apparatus and show some applications of the invention subject matter in realizing the air entrance modules and air exhaust modules. The air entrance and air exhaust modules can also be used for the improvement of the existing modules.

Figure 2:
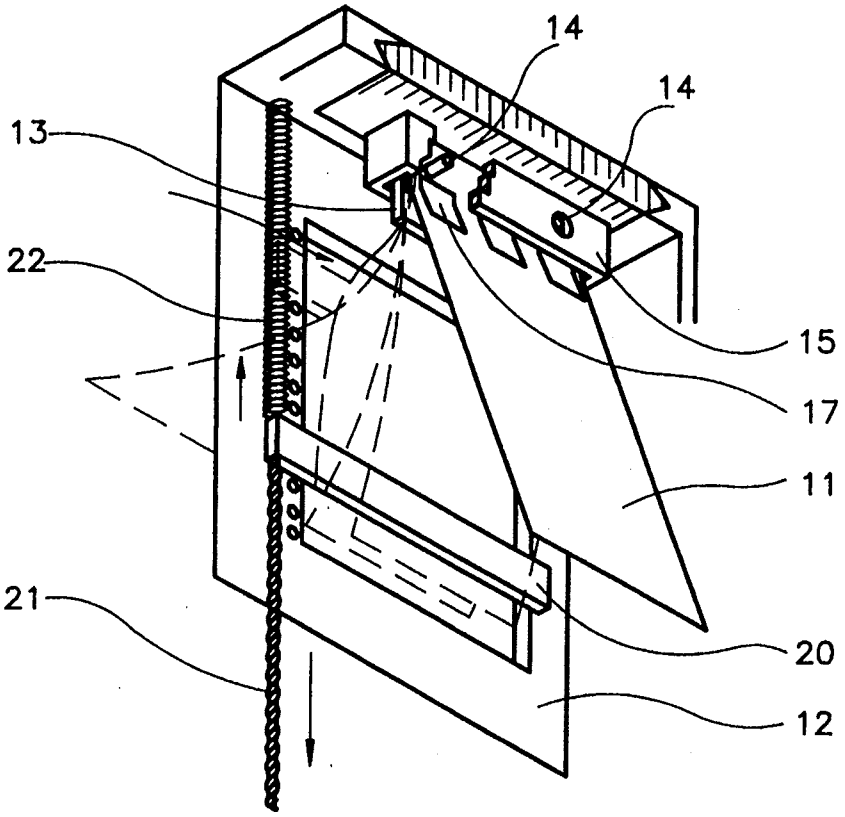
FIG. 2 is a schematic and perspective view of an automatic ventilation control apparatus according to the invention.

The improvement, which is the invention object, is represented in FIG. 2 and includes essentially an apparatus which allows the flexible membrane 11 to present a resistance to the bending which is different according to the direction (forward or rearward) to which it is subjected by the air-flow which runs through the casing 12, where the flexible membrane 11 is placed in the casing and is shown here in part.

Therefore, according to FIG. 2, the flexible membrane is retained at one of its horizontal ends by means of tenons, joggles, plugs, or hooks 14 by the stop 13. The membrane finds itself enclosed and embraced by a removable stop 15 against said stop 13 shown in FIGS. 2 and 2*a*. The removable stop 15 is clamped with its gripper or claw shape at the rear of said stop 13 as shown in FIG. 2*b*.

This construction and arrangement is placed in the casing 12, where the stop 13 is integral with the plate 16, which plate 16 is introduced into the upper side wall of the casing 12 by translatory motion and guided by a dovetail which surrounds it.

The membrane 11, which is furnished at the level of this construction thus retained in the casing 12, turns out to be capable of bending along two separate bending levels disposed at different distances from its mounting and fixation zone.

Figure 2B:
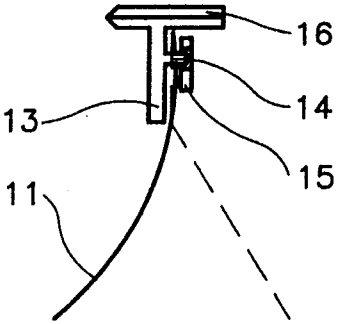
FIG. 2*b* is a schematic sectional view through anchoring plate support of said membrane.
Figure 2A:
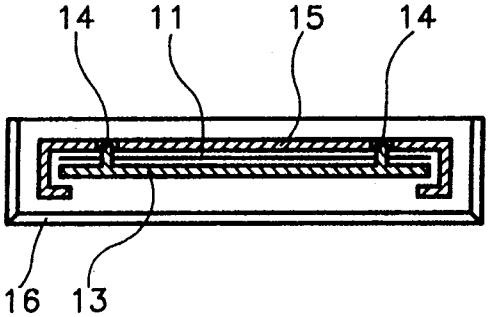
FIG. 2*a* is a schematic plan view from below onto a suspension system with the flexible membrane.

According to FIGS. 2 and 2*b* one notices in fact that the membrane 11, which is actuated toward the front of the casing 12 bends by taking a support on the removable stop 15 while, when actuated toward the rear, it bends by taking support on the fixed stop 13. Said fixed stop 13 is proportionally bigger in support size than the attachable stop 15 and is thereby offering a smaller free surface and, consequently, a higher bending moment as compared to the case where said membrane 11 is actuated forwardly.

Two different coefficients of flexibility are thereby obtained for said membrane 11, depending on the direction in which said membrane is actuated, which direction in turn is depending on the direction of the air current which passes through the casing 12. In order to increase this difference of resistance to bending according to the direction of the actuation of the membrane 11, said membrane 11 is furnished with oblong holes 17 illustrated in FIG. 2 which are located at the level of the lower edge of the detachable stop 15, which stop 15 is disposed very close to the attachments, thus decreasing additionally at this level the resistance to bending of said membrane by considerably reducing the material which forms the membrane. In contrast, the lower edge of the fixed stop 13, which is disposed the most distant from the attachments, is located outside of the zone of elongated holes 17 and provides at this level a higher resistance to bending as compared to the precedingly mentioned.

Figure 4:
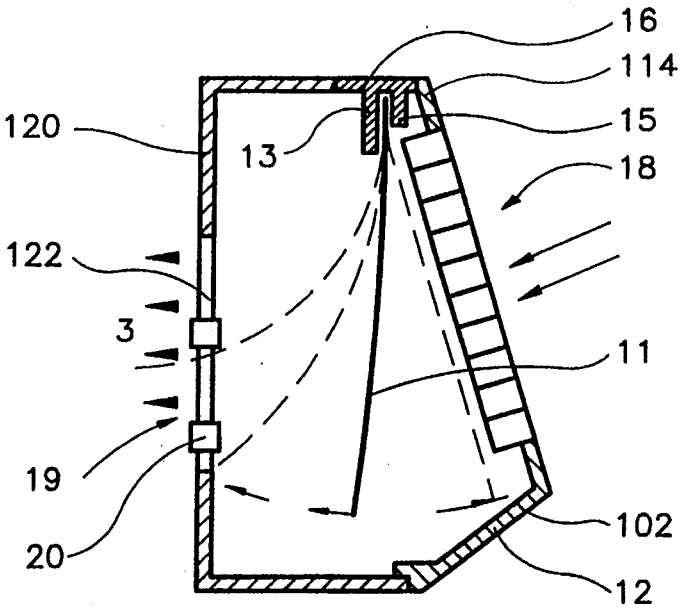
FIG. 4 is a schematic vertical sectional view of said casing showing the adjustable stop which modifies the ventilation surface.
Figure 3:
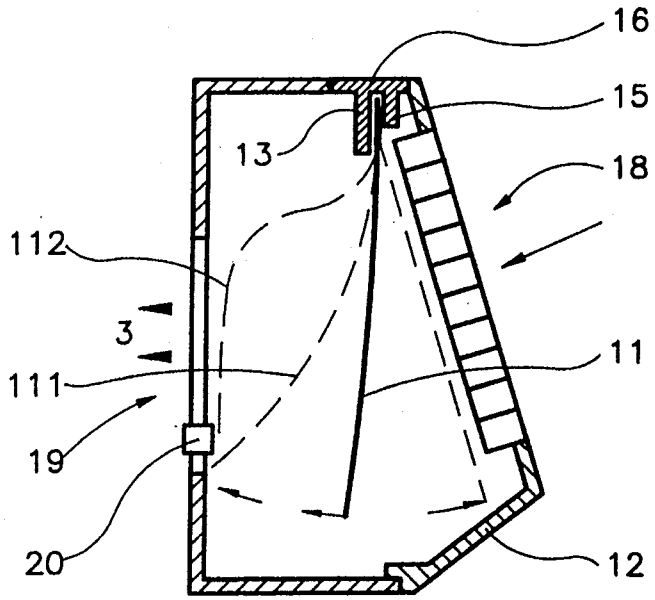
FIG. 3 is a schematic vertical sectional view of said casing containing the apparatus according to FIG. 2.

Such a device is located at the interior of the casing 12 as illustrated in FIGS. 2, 3 and 4 and one recognizes that the membrane 11 can block the front opening 18 under the effect of weak return of an air current coming from the interior of the conduit line. The membrane 11 can also be bent rearwardly under the effect of low pressure and/or underpressure generated in the ventilation conduits or ventilation ducts thus blocking more or less the rear opening 19 up to the point of overpassing said opening 19 as shown in FIG. 4, thus allowing a free passage of the air toward said ventilation conduit.

Preferably the attachment of the membrane is provided in a T-shaped structure furnished with pins 14, as shown in FIG. 2*b*, where the pins fit into holes provided in the membrane or entered into the membrane during attachment. The membrane then is fastened by a counterpiece stop 15 which is solidly attached to the pins 14. This attachment defines a perpendicular direction in the case of the embodiments of FIGS. 3, 4, 5 and 7 for one side of the membrane.

The rearward bending motion can be limited by a small mobile horizontal-bar 20 which is placed across the rear opening 19 and which can provide abutment for the base of the membrane 11 during its bending motion as shown in FIG. 3. Said small bar 20 can be vertically displaced parallel to itself within the rear opening 19 in such a manner as to modify the bending angle of the membrane 11 in order to allow the contact of an area of a base of said membrane 11 with said small bar.

The position of said small bar can even be set high enough to allow a free passage of the base of the membrane 11 across the opening 19 as shown in FIG. 4. This adjustment can be fixed already in a factory based on a desired destination in a building. It can also be effected by the user according to the desired intensity of the ventilation, for example, based on the humidity degree in the room. In the latter case as shown in FIG. 2, the small bar 20 can be manually moved by means of a string 21, where the small bar 20 is supported by one or by a plurality of opposing springs 22. The level of the position of the small bar 20 is controllable and can be subjected to a manual action or to an automatic action connected to a control device of the temperature or of the humidity.

According to FIGS. 3 and 4, the level of the small bar 20 can assume any position in the opening 122. When the small bar 20 is in its lowermost position, the lower end edge of the membrane should be contacting the bar in case of a stream passing through the casing 12. In case the small bar 20 is moved in its uppermost position in the embodiments of FIGS. 3 and 4 then the membrane should be extended outside of the casing with about 1/5 to ½ of its length and preferably with about ⅓ to 2/5 of its length.

The stiffness and strength of the membrane 11 is such that under normal conditions it will not move beyond the position 112 shown for the membrane in FIG. 3.

The elongated slot openings 17 effectively provide a hinge operation to the membrane 11.

The T-part 13 defines a vertical position of the membrane 11. The T-part 13 is extended from about 1.2 to 3 times and preferably from about 1.5 to 2 times lower and deeper than a lower extension of the attachment plate 15 in order to provide more stiffness to the membrane 11 when moving in the standard direction as compared to the direction where the membrane acts as a check-valve and closes a backward flow of air. As shown in FIG. 2 the perforations 17 are preferably disposed in the area of the membrane 11 which is facing the blocking section 13 or, alternatively, outside or in the area of the lower edge of the blocking section 15 shown in FIG. 2*b*. This allows the membrane 11 to turn unimpededly from a vertical position toward the opening in this sidewall 114 and only against the force of the plate 13 in a direction toward the sidewall 120 thereby forcing a bending of the membrane upon actuation in the direction toward the sidewall 120.

The embodiment in FIG. 3 shows that the membrane 11 can move between two positions, shown as the right and the left position. The membrane 11 will rest flatly on the opening 18. Relative to a vertical line the opening 18 is disposed at an angle of 5°–20° and preferably at an angle of 10°–15°. The membrane is generally positioned such that it will easily rest flat at the opening 18 in order to provide a sufficiently efficient seal against the backflow of air through the casing 12.

The flexibility of the membrane generally should be such that it allows the membrane to assume, under the influence of an airflow in the return direction, a first position 111 and a second position 112, where the first position is a position wherein the lower edge of the membrane just touches the small bar 20 and, where the position 112 is defined by wind which substantially presses the lower edge of the membrane 11 against the small bar 20 causing its bulging toward the opening 19. The increased flexibility of the membrane 11 based on the provision of the slots near the edge of attachment allows a stronger bending near this edge and thereby the membrane 11 can assume the position shown with the broken line in 112 when the force of a ventilation-air stream is substantial.

The wall 120 of the casing 12 supporting the small bar is furnished with an opening 122, where the opening 122 covers about ¼ to ¾ and preferably 2/5 to 3/5 of the rear wall vertical extension. Preferably the opening 122 is disposed substantially centrally in the wall 120. The position of the lower edge of the opening 122 should coincide approximately with the lower end edge of the membrane 11 as shown in FIGS. 3 and 4. The membrane 11 should overlap the full lower end of the opening 18 so that the backflow of air through the opening 18 can be completely prevented.

The casing 12 is preferably formed, as shown in FIGS. 3 and 4, of three sides which provide a rectangular structure followed by an input ventilation side 18 formed by two pieces disposed at an angle. The lower piece 112 forms an angle with the base of about 100°–150° and preferably of about 130°–140°. The angle between the sidewall 112 and the sidewall 114 can be about 100°–150° and is preferably about 110°–130°.

The rear face of the entrance opening 18 preferably forms a planar surface where the planar surface intersects with an effective hinge point of the membrane 11 such that the membrane 11 can rest flat on the opening 18 mounted into the wall 114.

In view of the force of gravity and in view of the flexibility and restoring forces of the membrane 11 as shown in FIGS. 3 and 4, the membrane without agitation assumes a preferred position where the membrane hangs vertically in the casing 12.

One recognizes that the thus formed apparatus allows different blocking coefficients depending on the direction of air circulation based on an automatic modification of the flexibility of the membrane depending on the direction in which said membrane is actuated, where the bending angle of the membrane is itself variable by adjusting the position of the movable stop 20 based on the immediate requirements of ventilation.

Figure 5:
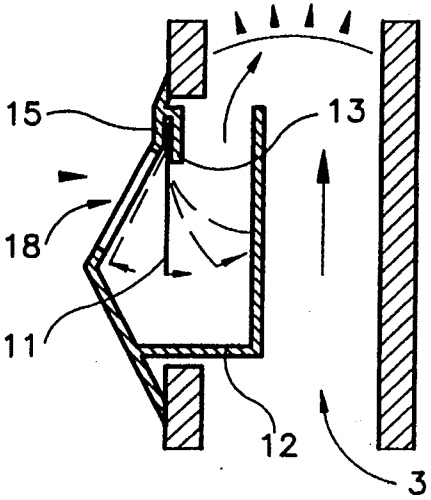
FIG. 5 is a schematic sectional view of a casing which contains the ventilation control apparatus according to FIG. 2 and structured in order to be placed at the louver of the ventilation duct.
Figure 6B:
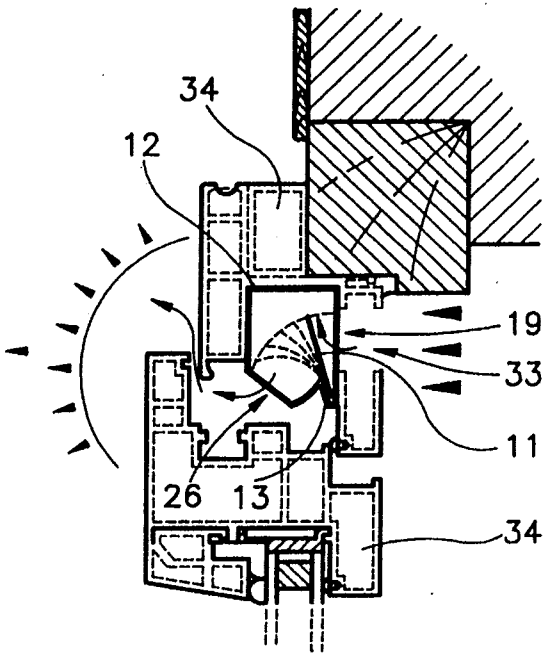
FIG. 6*b* is a schematic sectional view of a casing containing the automatic ventilation control apparatus according to FIG. 2 placed inside sections of a metallic joinery.
Figure 6A:
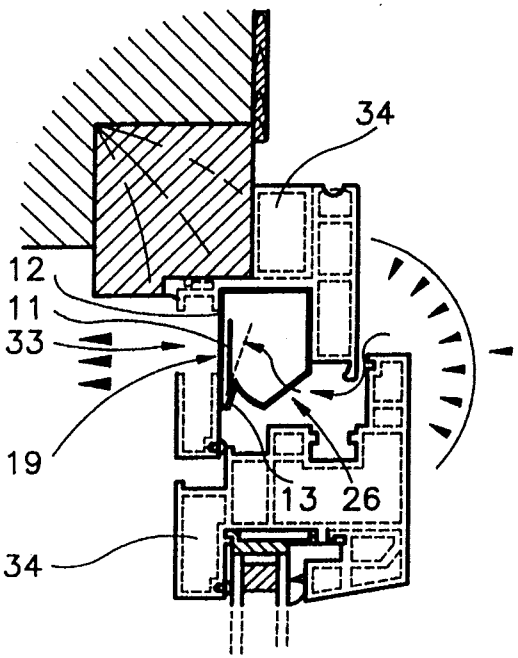
FIG. 6*a* is a schematic sectional view of a casing containing the ventilation control apparatus according to FIG. 2 placed inside sections of a metallic joinery.

Such a device which assures two different values of resistance to bending in one and the same membrane, depending on a different distance of its bending zone with respect to its attached end, can operate regardless of the position of said membrane, be it suspended as illustrated in FIGS. 2, 3, 4, 5 and 7 showing the openings of the evacuation of the used air toward the conduit lines, or positioned such that its bottom edge abuts against the base of the casing 12 in such a way that the bending of the membrane also operates at the level of two different zones according to the direction of its motion as shown in FIGS. 6*a* and 6*b* of FIG. 6 and in FIGS. 7, 8, 9 and 10.

When the membrane is hanging, its stable position is intermediate between the forward position and the rearward position of the membrane due to the gravity force. In contrast, according to the edgewise position of the membrane, two stable positions can be distinguished, where the first stable position is when the membrane is in the forward position, and the second stable position is provided when the membrane is in the rear position. In addition, the central position of the edgewise mounted membrane is a labile equilibrium position. As long as the angle between the forward position and the rearward position of the membrane is small, the forces required for advancing the membrane are substantially proportional to the angle desired in the case of the hanging membrane. In case of an edgewise mounted membrane, the membrane will tend to remain either in the forward or in the rearward position, thus providing a substantially two-way switch situation.

Figure 7:
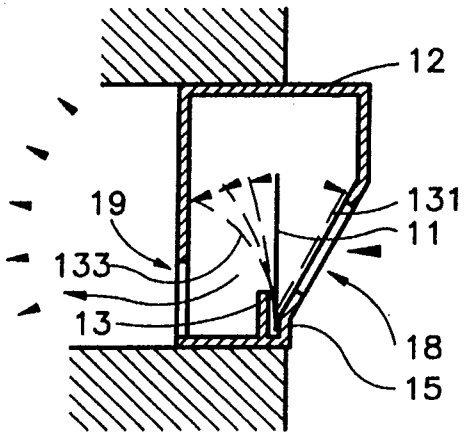
FIG. 7 is a schematic vertical cross-sectional view through a casing which contains the ventilation control apparatus according to FIG. 5 disposed upside down.
Figure 8:
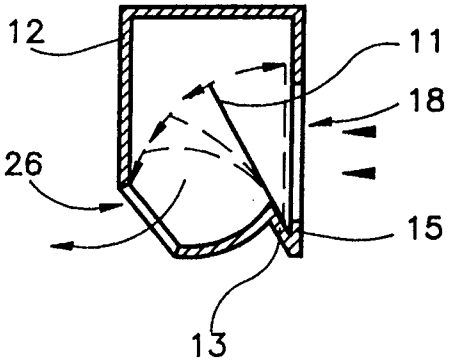
FIG. 8 is a schematic vertical sectional view of a different embodiment where the jointed edge of the automatic control membrane is disposed in the lower part of said casing.

According to FIGS. 7 and 8 the force of gravity and the restoring forces of the membrane 11 act on the membrane. The restoring forces of the membrane 11 attempt to maintain the membrane in a position as shown by reference numeral 11 in FIG. 7. In contrast, the force of gravity attempts to move the membrane into the position shown in FIG. 7 by reference numeral 131 or in the position shown by reference numeral 133. Depending on the relationship of the force of gravity onto the membrane 11, the forces of restoring of the membrane and the force of the air-stream flow, an adjustment can be provided which is set for a certain backflow before the membrane 11 can assume the position 131 and seal the casing 11 against further flow of back air. The operation according to FIG. 8 is similar to that of FIG. 7 with the difference that the gravity force in this case does not aid in closing the membrane as shown in FIG. 7 but this is done completely by the force of a back air stream and/or, respectively, by a suitable clamping giving a restoring force to the membrane. Preferably the opening of the casing for the exhaust of air in the normal direction as shown for example in FIG. 7 is provided on the same level where the flexible membrane 11 is hinged.

In the case of the edgewise mounted membrane, the casing 12 is composed of a principal element 23 shown in broken lines in FIG. 11, a vertical plate 24 comprising at its base a slider 25, where the membrane 11 is resting on the slider 25 by its lower edge and the stop 13 is located relative to said slider such as to increase the resistance to bending of the membrane 11 once it is actuated toward the plate 24, which plate 24 comprises a rear opening 26. The casing 23 thus formed includes otherwise at its upper part an opening 27 which can receive a rigid filter 28. The rigid filter 28 is open and punched and has a shape of a half-cylinder 128. The rigid filter 28 is furnished with a fine grid suspended inside of the rigid filter 28. The rigid filter 28 is mounted on said casing 23 at the level of said opening 27 by means of dovetails 30, which dovetails 30 delimit each of the generating end lines of said filter 28. The same filter 28 can be placed at the level of the opening 18 of the casing 23.

Figure 9:
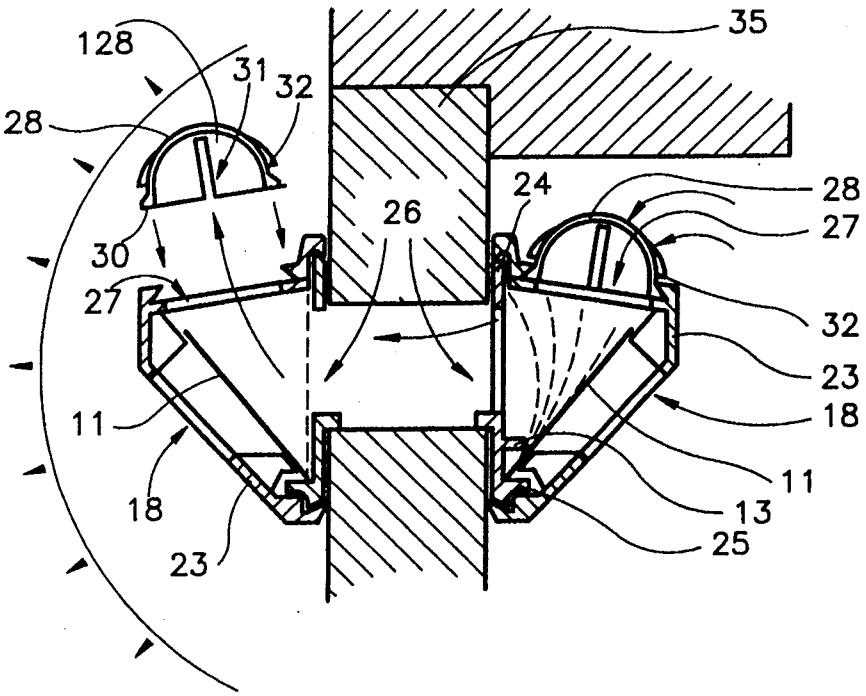
FIG. 9 is a sectional view of an apparatus according to FIG. 8 disposed on each one of two sides of one wall.
Figure 11A:
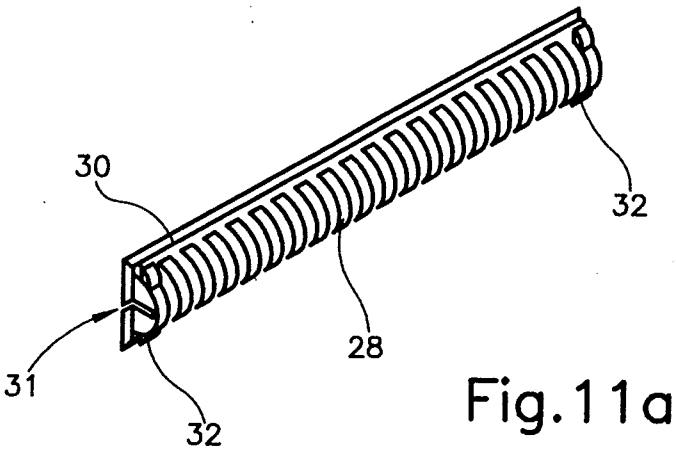
FIGS. 11*a*, 11*b* and 11*c* are an exploded view of the apparatus used according to FIGS. 9 and 10.

FIG. 11*a* shows the filter section similar to that shown in FIG. 9 on the right-hand side with reference numeral 28 and on the left-hand side with reference numeral 28. The parts 28 are substantially similar.

Figure 11B:
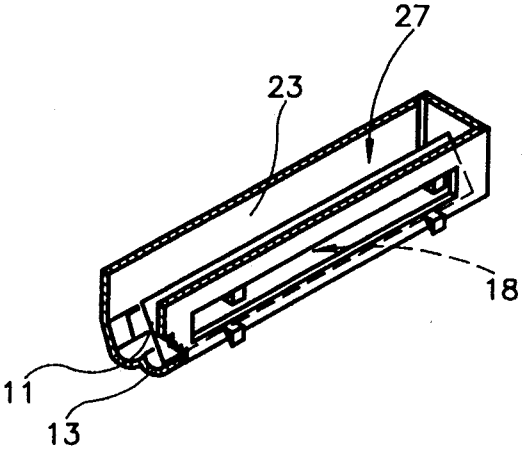
Figure 11C:
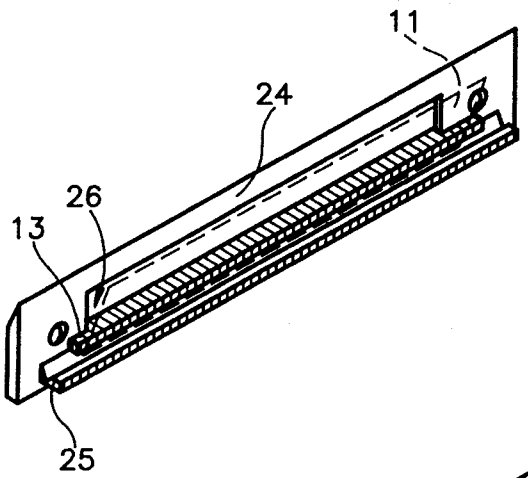

FIG. 11*b* shows then the left-hand side of FIG. 9 and shows the upper part open for the attachment of the filter 28. FIG. 11*c* shows the right-hand part of FIG. 9 again in its area attached to the wall 35. There is also shown the membrane 11 capable of closing an opening 26 in the attachment piece 24. Thus, in FIG. 9 the filter 28 substantially provides a bypass either for the incoming or the outgoing air as compared to the openings provided.

Thus, if a backflow of air occurs, the valve 11 on the right hand side will close, and the air will exit through the filter.

Figure 10:
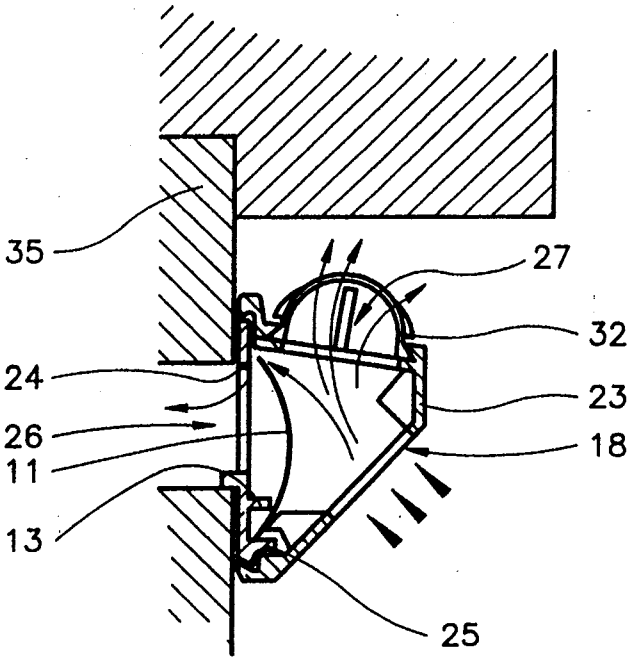
FIG. 10 is a sectional view showing a particular case for the use of the apparatus according to FIG. 8.

One notices that the filter 28, which performs its role of filtering the incoming air according to FIG. 9, can be automatically cleaned from impurities and dirt as shown in FIG. 10, where the wind, penetrating the opening 18 and pushing and pressing the membrane 11 against the opening 26, runs through said filter 28 from the interior of the casing 23.

One further notes that the filter 28, which is placed at the opening 27 of the casing 23 as shown in FIG. 9 on the inner face of the frame 35, generates a certain loss of charge necessary for actuating the membrane 11 in case of driving the air of the room outside in order to block the opening 26. This same loss of charge generated by the filter 28 has a similar function at the level of the same apparatus 23, but placed on the outside of the same door or window frame.

The apparatus thus formed can be placed according to FIG. 1 at the upper part of the frames. Such an apparatus can be placed at the outside as wall as at the inside of said frame 35 as shown in FIG. 9. According to the embodiment shown in FIG. 8, such apparatus can also be introduced into the interior of the metallic elements which are extruded of metallic joinery 34 shown in FIGS. 6*a* and 6*b*. The casing 12 is perfectly integrated to the interior of the metallic elements, regardless of their profile shape shown in FIGS. 6*a* and 6*b* by way of example. The air current circulating through the slot openings of the metallic elements left without sealing and insulating is controlled by the membrane 11 thus introduced into the circuit of the air current.

The filtering device 28 can be placed at the level of openings 33, which openings 33 are disposed in said metallic joinery 34, on their outer face perpendicular to the opening 18 of the incorporated casing 23 as illustrated in FIG. 9. Said filtering device 28 is furnished laterally at two sides with a radial slot 31, which radial slot 31 is open in the axis of the cylinder, which structure allows an elastic compression of the cylinder. Said filtering device 28 is also furnished at its side with toes or ergots 32 disposed close to the dovetails 30 and cooperating therewith in order to retain said device 23 in said openings 33. The filtering device 28 is introduced in the openings 33 by means of a locking and retaining pawl.

Thus, one can see that the apparatus, which is the subject matter of the present invention and which is shown in each of its embodiments described by way of example, allows an almost instantaneous counteraction of the membrane 10 against every changing and reversing of the air current direction from the rear to the front in the case of FIG. 9, no matter if the returning air runs from outside to the apartment or from the apartment to the conduit, thanks to the facility of bending the membrane 11 toward the opening 18 of the casing 23 containing the membrane 11. Inversely, thanks to the increase of the resistance to bending of the membrane 11 due to the presence of the stop 13, the apparatus allows in each case of FIG. 9 to control and to meter the access of the fresh air coming from the exterior into the apartment or from the apartment toward the conduit line. The automatic output control facility which is temporary or permanent and is obtained by the changing of position of the small bar 20, which limits the bending angle experienced by the membrane 11.

The same result is obtained in the case of FIGS. 5 and 7, where the membrane 11 allows in this case to control the aspiration and suction within the ventilation conduit 3.

Thus, it is possible to organize in a rational and hygienic way the ventilation of an apartment by metering through a preliminary setting of the position of the small bar 20 the fresh air exchanges in each of the rooms of the an apartment depending on the nature of the occupation of each of these rooms such as laundry room, kitchen, bathroom, etc. It is also possible to modify these air exchanges individually for each room based on the type of activity and the corresponding time of occupation such as meal times, bath hours, etc. thanks to the prepositioning of the small bar 20, which is effected either manually by way of the string 21, or automatically by means of a thermostatic command, or a hygrometric command, or by any other command in a way to control the entry of fresh air depending on temperature or humidity.

This regulation of the ventilation of each room of one apartment allows obviously to organize with the same facility and ease the coordination of automatic control of the ventilation on different floors of one and the same building in order to obtain the automatic control of output and efficiency shown in the diagram 1*c* of FIG. 1.

It will be understood that each of the elements described above, or two or more together, may also find a useful application in other types of ventilation systems differing from the types described above.

While the invention has been illustrated and described as embodied in the context of an improvement for apparatus insuring distribution and automatic control of air supplies in particular for ventilation of buildings it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An automatic control device for ventilation comprising a casing having two opposite faces and furnished with two openings and an upper wall, wherein the openings are disposed on the opposite faces of the casing;

a flexible membrane having a horizontal edge and capable of furnishing a plane surface and contained in the casing between the two openings, wherein the flexible membrane is disposed and fastened edgewise at the horizontal edge of the flexible membrane, and wherein the flexible membrane is free to oscillate under the action of an air current which flows through said casing in order to block more or less one of the two openings according to the direction of the air current, and wherein the flexible membrane is attached such that the bending moment experienced by the flexible membrane subjected to an air current is different depending on a direction of actuation of said flexible membrane by the air current.

2. The automatic control device for ventilation according to claim 1, wherein the flexible membrane is planar and is mounted at the level of the horizontal edge between a first stop and a second stop, wherein one of the first stop and of the second stop is longer as compared to the other stop in a manner for modifying the effective length of said flexible membrane facing the air current depending on the direction in which the flexible membrane is actuated by the air current, and thereby modifying the bending moment to which said flexible membrane is subjected.

3. The automatic control device for ventilation according to claim 2, further comprising elongated slot holes disposed in the flexible membrane and furnished in said flexible membrane at the level of an attachment point of the flexible membrane on the shorter one of the first stop and second stop, wherein a bending strength difference of the flexible membrane in one of said directions is increased by the presence of the slot holes, thereby reasonably reducing in this point a surface of remaining material such that a bending of the flexible membrane takes place at the level of the line of the elongated slot holes in a direction, where the flexible membrane is abutted against this shorter stop and moves beyond the zone of the elongated slot holes in the direction where said flexible membrane abuts against a longer one of the first stop and of the second stop.

4. The automatic control device for ventilation according to claim 2, further comprising tenons, wherein the flexible membrane is retained by the tenons on the first stop, and wherein the flexible membrane is immobilized relative to the first stop by having the second stop detachable and in a form of a gripper, and wherein the second stop encloses said first stop;

a plate having an edge and including dovetails disposed at the edge of the plate, wherein said first stop is integral with the plate, and wherein the plate is introduced into the upper wall of the casing by translatory motion, guided by the dovetails.

5. The automatic control device for ventilation according to claim 2, wherein the flexible membrane is positioned edgewise in a floor base of the casing.

6. The automatic control device for ventilation according to claim 1, further comprising a small bar placed horizontally across a rear one of the two openings, wherein a level of positioning the said small bar is controllable with a purpose of controlling a surface allowing passage of air through said opening, wherein a displacement of the flexible membrane in a direction of its largest bending strength is limited by the small bar, and wherein the level of the flexible membrane at a position of the small bar is adjustable such that the flexible membrane can pass through the rear opening, thereby freeing the rear opening completely and allowing passage of air through the rear opening.

7. The automatic control device for ventilation according to claim 5, wherein the casing is provided in the shape of an elongated prism, which casing is capable of being introduced into the interior of extruded elements of metallic joinery.

8. The automatic control device for ventilation according to claim 7, further comprising a slide located at the floor base of a vertical plate of the casing, wherein the flexible membrane is positioned edgewise on said slide, wherein a bending strength of said flexible membrane is increased by the first stop in the bending of the flexible membrane for attaining a rear one of the two openings based on a strength of the air current penetrating through the rear opening, wherein the rear opening is defined by said plate.

9. The automatic control device for ventilation according to claim 1, further comprising a rigid, pierced and perforated filter having a half-cylindrical shape and dovetails located on each one of outer generating lines of said filter, wherein the rigid, pierced and perforated filter comprises in its interior a fine grid, wherein the casing includes in its upper part a third opening covered with the rigid, pierced and perforated filter, and wherein the rigid, pierced and perforated filter is retained in said casing at the level of said third opening by means of the dovetails.

10. The automatic control device for ventilation according to claim 9, further comprising a radial slot carried by the rigid, pierced and perforated filter on each of lateral extremities of the rigid, pierced and perforated filter, and wherein the rigid, pierced and perforated filter is furnished at two sides of an outer periphery of the rigid, pierced and perforated filter with ergots, wherein the dovetails are male, wherein the ergots are disposed in the neighborhood of the male dovetails, and wherein the ergots cooperate with the male dovetails in order to allow support of the rigid, pierced and perforated filter by a locking pawl at the level of a respective wall opening such that the third opening of the casing is located at the outside of a window frame and of an opening of a metallic joinery into which the casing is introduced.

11. An automatic control device for ventilation, in particular for premises, which includes a flexible membrane contained in a casing which is furnished with two openings which are disposed on opposite faces of the casing, wherein the flexible membrane is disposed between the two openings, wherein the flexible membrane is fastened at a horizontal edge, and wherein the flexible membrane is allowed to oscillate freely under the action of an air current which flows through said casing in order to block more or less one of the openings according to the direction of the air current, wherein, the flexible membrane (11) furnishes a plane surface and is retained in the casing (12), furnished with the oppositely disposed openings (18) and (19) such that its bending moment is different according to the direction in which said flexible membrane (11) is actuated by the air current.

12. The automatic control device for ventilation, in particular of premises, according to claim 11, wherein the flexible membrane (11) is planar and is fitted and inserted on a level of the horizontal edge between a first stop (13) and a second stop (15), wherein one of the two stops, for example the first stop (13), is longer as compared to the second stop (15) such as to modify an insertion length of said flexible membrane (11) depending on the direction in which it is actuated, thereby modifying in each bending direction the bending moment to which said flexible membrane (11) is subjected, and wherein the second stop (15) is a detachable stop.

13. The automatic control device for ventilation, in particular of premises, according to claim 12, wherein a bending strength difference of the flexible membrane (11) is increased by a presence of a line of elongated slot holes (17) which are furnished in said flexible membrane at a level where the flexible membrane (11) rests on the shorter, second stop (15), thereby substantially reducing in this point the surface of remaining material of the flexible membrane (11) such that its bending takes place at the level of the line of elongated slot holes (17) such that the flexible membrane rests on said second stop (15), and wherein a bending of the flexible membrane (11) beyond a zone of the elongated slot holes (17) takes place such that said flexible membrane (11) comes to rest on the longer stop (13) which is the most distant from the insertion.

14. The automatic control device for ventilation, in particular of premises, according to claim 12, wherein the flexible membrane (11) is retained by tenons and joggles (14) on the first stop (13), and wherein the flexible membrane (11) is immobilized relative to the first stop (13) by the second stop (15) in the form of a clamp which grips said first stop (13), wherein said first stop (13) is integral with a plate (16) introduced into an upper wall of the casing (12) by translatory motion, guided by dovetails bordering said plate (16).

15. The automatic control device for ventilation, in particular of premises, according to claim 12, wherein the flexible membrane (11) is positioned edgewise on a floor base of the casing (12).

16. The automatic control device for ventilation, in particular of premises, according to claim 11, wherein a displacement of the flexible membrane (11) in a direction of its largest bending strength is limited by a small bar (20) placed horizontally across a rear opening (19) with the purpose of controlling a surface of air passage through said opening, wherein a height level of the small bar (20) can be such that the flexible membrane (11) can pass across the rear opening (19), thereby clearing the rear opening (19) completely, wherein the height level of said small bar (20) is controllable.

17. The automatic control device for ventilation, in particular of premises, according to claim 15, wherein the casing (12) is shaped like an elongated prism (23) which is capable of being introduced inside extruded elements of a metallic joinery (34).

18. The automatic control device for ventilation, in particular of premises, according to claim 17, wherein the flexible membrane (11) is positioned edgewise on a slide (25) located on the floor base of a vertical plate (24) of the casing (23), wherein a bending strength of said flexible membrane (11) is increased by the stop (13) in its bending for reaching a rear opening (26) of said vertical plate (24) based on the air current penetrating through the opening (18) of said casing.

19. The automatic control device for ventilation, in particular of premises, according to claim 18, wherein the casing (23) includes in its upper part an opening (27), wherein the opening (27) is capped with a rigid, pierced and perforated, hemicylindrical filter (28), wherein said filter (28) is lined inside witch a fine grid, and wherein said filter (28) is retained in said casing (23) at a level of said opening (27) by means of dovetails (30) located on each one of the generating line extremities of said filter (28).

20. The automatic control device for ventilation, in particular of premises, according to claim 19, wherein the filter (28) includes on each one of its lateral extremities a radial slot (31) and is furnished at its outer periphery, on both sides of said lateral extremities, with ergots (32), which are disposed in the neighborhood of the male dovetails (30), and wherein the ergots (32) cooperate with the male dovetails (30) in order to allow a support of the filter by a locking at a level of each of the openings, such as the opening (27) of the casing (23) at the outside of a window frame (35) and an opening (33) of the metallic joinery (34) into which the casing (12) is introduced.

* * * * *